US011162273B2

(12) United States Patent
Hutnak

(10) Patent No.: US 11,162,273 B2
(45) Date of Patent: Nov. 2, 2021

(54) OUTDOOR EQUIPMENT

(71) Applicant: Markus Hutnak, Santa Cruz, CA (US)

(72) Inventor: Markus Hutnak, Santa Cruz, CA (US)

( * ) Notice: Subject to any disclaimer, the term of this patent is extended or adjusted under 35 U.S.C. 154(b) by 0 days.

(21) Appl. No.: 16/939,597

(22) Filed: Jul. 27, 2020

(65) Prior Publication Data

US 2021/0032897 A1 Feb. 4, 2021

Related U.S. Application Data

(60) Provisional application No. 62/922,281, filed on Aug. 1, 2019.

(51) Int. Cl.

| | |
|---|---|
| ***E04H 15/54*** | (2006.01) |
| ***E04H 15/60*** | (2006.01) |
| ***A45F 3/08*** | (2006.01) |
| ***E04H 15/56*** | (2006.01) |
| ***E04H 15/40*** | (2006.01) |

(52) U.S. Cl.

CPC ..... *E04H 15/54* (2013.01); *A45F 3/08* (2013.01); *E04H 15/40* (2013.01); *E04H 15/56* (2013.01); *E04H 15/60* (2013.01)

(58) Field of Classification Search

CPC ..... E04H 15/40; E04H 15/54; E04H 15/56; E04H 15/60

See application file for complete search history.

(56) References Cited

U.S. PATENT DOCUMENTS 4,236,543 A * 12/1980 Moss ..... E04H 15/40 135/116
6,013,586 A * 1/2000 McGhee ..... E04H 15/425 442/131
10,428,541 B2 * 10/2019 Harve ..... E04B 1/12

FOREIGN PATENT DOCUMENTS

CN 107795191 A * 3/2018
CN 108222645 A * 6/2018
CN 108411400 A * 8/2018
CN 108643687 A * 10/2018

* cited by examiner

*Primary Examiner* — Noah Chandler Hawk
(74) *Attorney, Agent, or Firm* — Russell O. Paige

(57) ABSTRACT

The invention encompasses certain graphene-enhanced products for the outdoor industry, including tents, backpacks, hiking accessories, and apparel. Specific embodiments include (1) a tent comprising at least one flexible tent pole configured as an arch, connected to at least one fabric wall element that is connected to a second fabric element comprising a tent floor, wherein at least one of the tent pole and the first and second fabric elements is graphene enhanced; and (2) a backpack comprising a rigid frame, connected to a fabric sack portion, where at least one of the frame and the sack portion comprises graphene.

13 Claims, 6 Drawing Sheets

OUTDOOR EQUIPMENT

BACKGROUND OF THE INVENTION

Field of the Invention

The present invention relates generally to certain products for the outdoor industry as well as emergency and medical shelters, including tents, tarps, textile wings, and backpacks, and improvements to such products, using graphene. Graphene-enhanced products feature more resistance to abrasion, punctures and tears and propagation of tears. Further, such materials are more waterproof and durable, and in fact more durable in every other mechanical characteristic of the material than their conventional graphene-free counterparts. These graphene-based products have these desirable features without adding weight or volume, which would be required to achieve such features in the absence of graphene.

Background of the Prior Art

Products used in the outdoor recreation industry, and more particularly by outdoor adventurers including hikers, mountain climbers, trekkers, campers, and backpackers, as well as by the military and other warfighters, embody many features that enhance theft utility. Such products have applications in areas besides the outdoor recreation industry, for example emergency shelters, event tents, medical tents, military field operations, industrial shelters, and pop-up structures for recreation and to protect from elements (e.g., temporary housing). Certain of these features are of such vital importance that they can literally be lifesaving. Weight and strength are vital characteristics of outdoor equipment, and combinations of lightweight durable framing components supporting fabric elements have been used to great effect. The frames in such equipment need to be light yet strong. Such frames benefit from varying degrees of flexibility, and conversely, rigidity. For example, in the case of tent frames, lightweight flexible poles are often used, configured in the shape of an arch, to support the fabric comprising the roof and walls of the tent. Such tent poles need to be tremendously strong to withstand the stresses transmitted to the poles by the surface of the fabric, especially in high wind conditions or in the presence of excessive snow loads. Conversely, clips that connect tent poles to other tent components, or clips that connect backpack components, need to be rigid in order to cause the connected frame elements to assume and maintain the desired shape that the frame is intended to provide to the user and to effect the product purpose; i.e. protect from the elements, failure of which could be catastrophic. At the same time, such tent clips and similar accessories need to be sufficiently flexible to permit theft proper operation. For example, a substantially rigid tent pole clip might need to be sufficiently flexible to permit it to clip onto, and release from, a tent pole or another piece of equipment, such as the frame of a backpack. Even relatively simple items such as trekking poles require a combination of strength, rigidity, flexibility, and durability without being excessively heavy.

Further, in the case of tents, the tent must not only be as lightweight, compact, and portable as possible, it must also be easy to assemble and disassemble, in every conceivable weather condition. Ease of assembly and disassembly is enhanced by keeping the tent's construction to a minimum number of separate pieces. Once assembled, within the limitations imposed by the foregoing requirements, the optimum tent provides maximum amount of floor space as well as maximum internal volume. It is generally desirable, especially for wilderness hikers and adventurers, that the tent include an attached floor, which demands a strong, durable, preferably waterproof and puncture resistant fabric. Ideally, the tent provides easy ingress and egress and ventilation, while providing adequate shelter from weather, which can be extreme. The optimum tent must be able to function in all weather conditions including extremely high winds and must be able to support or shed surface loads such as rain, snow, and even hail. Many tent designs exist in the prior art, yet no tent has adequately optimized all of these desirable features.

Despite having positive aspects such as strength and durability, collapsible tents that are suited for industrial use are generally not suited for recreational use because of specific features that include high profiles, square footprints and generally flat roofs. The high profile will cause such a tent to be exposed to greater risk of damage from high winds. Flat roofs will be subject to damage—up to total failure (e.g., collapse)—from rain, snow, sleet, hail, and from falling objects that might otherwise deflect off a sloping or dome-roofed tent. Furthermore, such a tent may require multiple subframe assemblies, which negate the need for simplicity of assembly and disassembly. As can be readily understood, an increasing number of required frames increases the weight of the tent thereby decreasing its portability.

A further requirement of outdoor recreational equipment is the ability of the equipment to keep its contents as dry as possible. In rainy conditions, a wet camper must deal not only with discomfort, but also with heat loss. In such rainy conditions, external sources of heat such as a campfire might be impossible to maintain. Thus, when a camper becomes wet, he is likely to remain so for a while. The same is true for the camper's equipment, including the contents of a backpack. Body heat is rapidly lost through wet garments, and for the outdoor adventurer poses a danger of hypothermia in situations where clothing, sleeping bags, and tents have become wet, and no ready solution is available for drying or providing heat. Thus, a dry environment for such outdoor activity is of paramount importance for enjoying the outdoor experience, and even in preserving life in certain situations.

Waterproof roof panels and rainflies are well-known in the prior art and can be effective in deflecting rain from the upper portion of a tent. However, when such components are reinforced or, as in the case of a rain fly, such additional protection from rain comes at the cost of additional weight.

Backpacks that are used by outdoor adventurers for carrying customary items, including camping gear, clothing, and food, typically comprise a relatively rigid frame, to which fabric sack-like components are attached. The backpack frame may be arranged either external or internal to the sack portion. An internal frame backpack includes a fabric sack with frame structure integrated in the sack. An external frame backpack includes a rigid frame and a separate sack which is removably mounted on the frame. The fabric sack of an external frame backpack is commonly attached to the frame by pins which are inserted through the frame and into reinforced grommets sewn in or otherwise attached to the fabric comprising the sack portion of the backpack. When the backpack is filled, the weight of its contents applies forces at the grommets, which are point stresses in those precise locations. Thus, the areas of the fabric sack where the grommets are attached require substantial reinforcement.

As with all outdoor equipment concerned herein, weight and strength are important characteristics of a backpack's frame and sack. A backpack typically includes a suspension system comprising a pair of shoulder straps, and a waist belt that is designed to direct as much as possible the weight of the backpack's contents to the user's hips. Typically the suspension system is adjustable, to accommodate various torso shapes and to adjust how the user's body will support the load, primarily by the user's shoulders and hips.

It is thus an object of the present invention to solve the problems existing in outdoor equipment and to improve the features in outdoor equipment.

It is further an object of the present invention to provide outdoor equipment with improved properties of reduced weight combined with increased strength and durability of the materials related to maintaining the structural integrity of the equipment.

DISCLOSURE OF THE INVENTION

"Graphene" is the name for a honeycomb sheet of carbon atoms. It is atomically the building block of graphite—pencil lead—and is an incredibly strong but flexible material. Graphene belongs to a family of materials called "2D" or "layered materials." These are essentially huge molecules that can be as big as 1 cm wide but are only a few atoms thick. They are called two-dimensional because all the atoms are at the surface and they have no bulk. Fascination with this material stems from its remarkable physical properties and the potential applications they offer.

The vast number of products, processes and industries for which graphene could create a significant impact all stems from its amazing physical properties. No other material has the breadth of superlatives that graphene boasts, making it ideal for countless applications.

- It is many times stronger than steel, yet incredibly lightweight and flexible.
- It is electrically and thermally conductive but also transparent.
- It is the world's first 2D material and is one million times thinner than the diameter of a single human hair.

With graphene, if it is incorporated in a waterproof coating for example, the waterproofness is more durable as well as the fabric. For example, not all materials are waterproof and simply adding graphene doesn't mean that the graphene-enhanced material is waterproof. However, if graphene is incorporated in a polyurethane waterproof coating to make a textile waterproof, then the addition of graphene to the polyurethane makes the coating durably waterproof. This durably waterproof attribute is independent of the additional durability afforded to the graphene-enhanced base textile itself.

This invention applies graphene to certain applications for the outdoor industry and other practical environments, namely, tents, backpacks, parachutes, boat sails, footwear and apparel, producing products that have improved textile protection including from abrasion, puncture, tear, tear propagation; and also improved durability. The invention further includes the effects of enhanced mechanical properties of fabric, textiles, and both rigid and flexible materials without adding weight or volume.

DETAILED DESCRIPTION OF SPECIFIC EMBODIMENT

Figure 1:
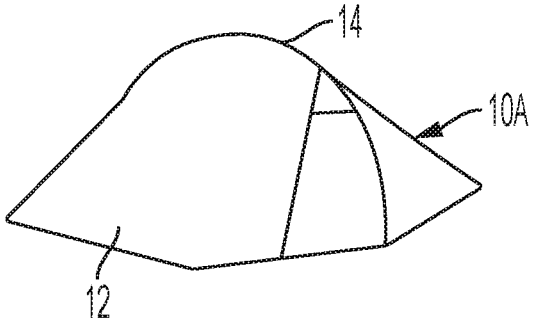
FIG. 1 is an example of a single pole tunnel tent having several features that may be incorporated in an embodiment of the invention.
Figure 2:
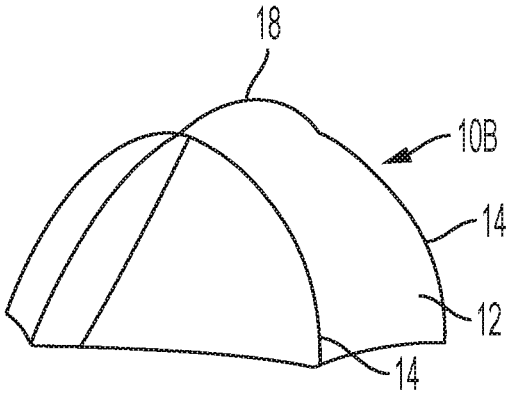
FIG. 2 is an example of a three pole dome tent having several features that may be incorporated in an embodiment of the invention.

FIGS. 1 and 2 of the accompanying drawings depict two exemplary tent shapes popular among outdoor adventurers namely tunnel (FIG. 1) and dome (FIG. 2) shapes. Each tent 10 comprises an outer fabric layer 12 stretched over poles 14 of, for fiberglass or other suitably flexible material, retained in sleeves attached to the fabric comprising the main body of the tents. Poles 14 are implemented in the form of arches and are typically made up of elastic cord-linked, substantially straight flexible sections joined end to end. The sections can be decoupled to permit compact storage.

In FIG. 1, a single pole tunnel tent 10A is shown in which the single arched pole 14 supports the tent wall fabric 12. In varying embodiments the arched pole 14 may be internal relative to the tent wall fabric 12 or external. FIG. 2 depicts a three-pole dome tent 10B, in which arched poles 14', 14" are arranged parallel to each other and the third pole 18 is transverse thereto. Typically in a three-pole tent the poles will be external to the tent wall fabric 12, connected to the tent wall 12 by sleeves (not shown).

One or more specific embodiments will be described below. In order to provide a concise description of these embodiments, all features of an actual implementation might not be described in the specification. It should be appreciated that in the development of any such actual implementation, as in any engineering or design project, numerous implementation-specific decisions must be made to achieve the developer's specific goals, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments disclosed herein, the articles "a," "an," "the," and "said" are intended to mean that there are one or more of the elements.

The terms "comprising," "including," and "having" are intended to be inclusive and mean that there may be additional elements other than the listed elements.

While embodiments of the improved outdoor equipment are described below with reference to tent applications, it should be appreciated that the invention may be employed to improve components within other outdoor equipment, such as backpacks, boat sails, parachutes, gliders, footwear and apparel, as well as related accessories.

Figure 3:
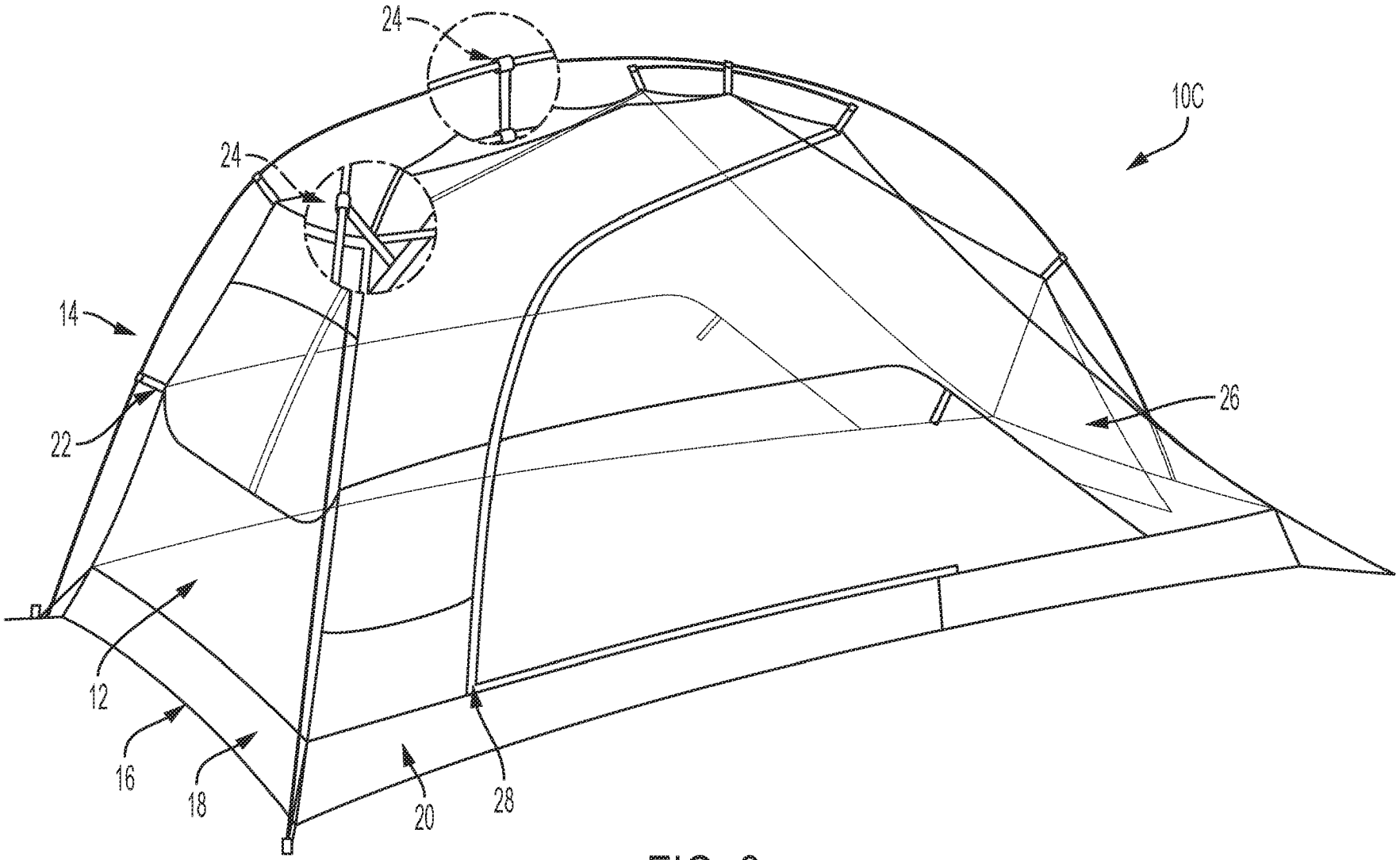
FIG. 3 is a perspective view of a tent having several features that may be incorporated in an embodiment of the invention.

An embodiment of the invention is depicted in FIG. 3, which depicts a partial cutaway view of a tent 10C used in outdoor activity such as hiking, camping, and mountain climbing. The embodiment shown in FIG. 3 incorporates all the elements shown in FIG. 1 and FIG. 2, and comprises graphene incorporated in at least certain portions of the elements of the tent. Such an embodiment may include graphene-enhanced yarn for the fabric of the tent floor 16. Tent floor 16 is joined contiguously with tent wall fabric 12, and tent floor 16 may include a lip portion 18 that extends vertically along the tent wall 12. The tent floor 16 bears the weight of any contents of the tent including persons and gear, and directly contacts the surface of the ground where the tent is pitched. As such, the tent floor will be subjected to severe friction stresses, which may be so severe as to cause the fabric of tent floor 16 to wear, even so as to tear, puncture, or shred. By incorporating graphene in the construction of the tent floor 16, the tent floor 16 can minimize degradation from such frictional stresses. The graphene may be incorporated in the weaving of the fabric or may be applied as a single layer, as in a coating. More particularly in such a coating, the graphene is typically multiple graphene layers thick. In fact the graphene may be physically incorporated analogous to a suspension—suspended in the polyurethane or other base material coating applied to the fabric.

Multiple layers may also be applied, and the tent floor fabric 16 may comprise multiple alternating layers of fabric and graphene. Application of graphene enhancement may be used with any fabric element in a tent such as is depicted in FIG. 3, but the embodiment including a graphene-enhanced tent floor represents an exemplary best mode of the present invention.

Further in FIG. 3, the seam 20 joins tent floor 16 to the lip portion 18 of the tent floor. Seam 20 is subjected to stresses transmitted along tent wall 12 and tent floor 16. Graphene enhancement of seam 20 permits seam 20 to withstand far greater stresses than fabric without graphene enhancement. The graphene enhancement in such an application may be a coating, in which embodiment seam 20 obtains a highly durable waterproof condition. The utility of such a durable waterproof feature of the present invention is apparent especially at seam 20, where the tent 10C may be exposed to water from a variety of sources:

rainwater descending from tent wall 12;

condensation forming on tent wall 12 and lip portion 18;

moisture from saturated ground below tent floor 16;

moisture from melting snow or ice below tent floor 16;

among other sources of encroachment of moisture, which is undesirable. Graphene enhancement of seam 20 further enhances the utility of the present invention by creating a seam 20 of dramatically improved strength compared to the prior art tent seams. The strength of exemplary seam 20 is especially important when a tent is pitched in extreme conditions, such as on a rocky perch with little or no soil, under extreme wind conditions, and when pitched on ice or snow. Such conditions can cause extreme stresses on seam 20, which must remain intact for tent 10C to perform its intended purpose of sheltering its user and contents by forming a substantially impervious structural barrier against the elements.

Further in the embodiment depicted in FIG. 3, tent pole 14 is connected to tent wall 12 by a sleeve 22. Even in static conditions sleeve 22 is subjected to stresses from the flexible tent pole 14 that is configured to hold tent 10C in a configuration to provide maximum internal volume. In conditions of high winds, or when tent 10C is pitched on such irregular and/or non-level terrain, the stresses can cause sleeve 22 to break, tear, or burst. Graphene enhancement of sleeve 22 overcomes the risk of failure of sleeve 22 by dramatically improving the strength of sleeve 22, with the added benefit that due to the added strength provided by graphene enhancement, a sleeve 22 may be provided with less fabric material, thereby less weight and less volume, which is of paramount importance to the user.

In the embodiment depicted in FIG. 3, exemplary tent pole clips 24 are shown. Tent pole clips 24 are used in conjunction with tent poles 14 in a variety of configurations, all of which are improved by graphene enhancement. Tent pole clips 24 may be used to connect a section of tent pole 14 to other sections of tent pole 14, as well as to other elements as depicted in detail in FIG. 6. In a preferred embodiment of the present invention, tent pole clips may comprise graphene-enhanced plastic resin, polyurethane, or graphene-enhanced composite material such as fiberglass, Kevlar, or carbon fiber. In such an embodiment, the plastic resin or composite fiber might be mixed with graphene and molded, as in an injection molding process, to produce the improved tent pole clips 24. Further, graphene-enhanced plastic resin might be formed into tent poles 14 using a process by which the graphene-enhanced plastic resin is extruded or otherwise manufactured to create a suitable tent pole 14. Other materials than plastic resin might be employed, which materials could be mixed with graphene in a manner to improve their performance. Persons of ordinary skill will recognize the available processes for manufacturing the aspects of the invention disclosed herein.

As depicted in FIG. 3, a tent 10C may include mosquito netting 26, which in the present embodiment is improved by graphene enhancement that may be incorporated in the weaving of the mosquito netting fabric or may be applied as a single layer to the fibers or threads comprising mosquito netting 26, as in a coating. As in other graphene enhancements comprising a coating application, the graphene will be more than a single microscopic layer deep. It will typically be multiple microscopic layers of suspended graphene in a coating application. For the mosquito netting filament itself, the thread can be extruded with graphene.

Further in the embodiment, graphene may be employed as a coating to any elements of tent 10C thereby producing improved tent elements that may be further improved by layering multiple coated materials. Further by way of example, the fabric used for tent floor 16 will typically have a waterproof coating, normally a polyurethane or silicone or a coating with similar waterproof properties. In the embodiment of the present invention depicted generally in FIG. 3, graphene may be included in a coating that is applied to any of tent wall 12, tent floor 16, tent floor lip 18, and sleeves 22, thereby improving the resistance of the fabric to abrasion, puncture, and tear without an increase in weight compared to the prior art. In yet a further enhancement to the embodiment of FIG. 3, tent 10C or an element of tent 10C might comprise a layered fabric where each layer is arranged so that the fibers of each layer run orthogonally or obliquely to each other in order to improve strength and resistance to puncture and wear. Employing graphene in one or more such layers will result in a further improved tent.

In the embodiment depicted in FIG. 3, portions of tent wall 12 include access panels defined by zippered openings 28. Zippered openings in any tent create stress points that can cause failure of tent integrity. Graphene enhancement of the zippered openings including especially the seams where zippered openings 28 join tent wall 12 dramatically enhance the utility of a tent by increasing the reliability of the tent 10C regardless of the configuration of zippered opening 28. It is a feature of the present invention that the graphene enhanced zippered opening 28 is so much more durable and so much stronger than its counterpart in the prior art that any tent embodying the present invention can employ zippered openings in nearly every configuration without compromising tent integrity, thereby enhancing the utility of tents embodying the graphene enhanced elements of the present invention.

Figure 4:
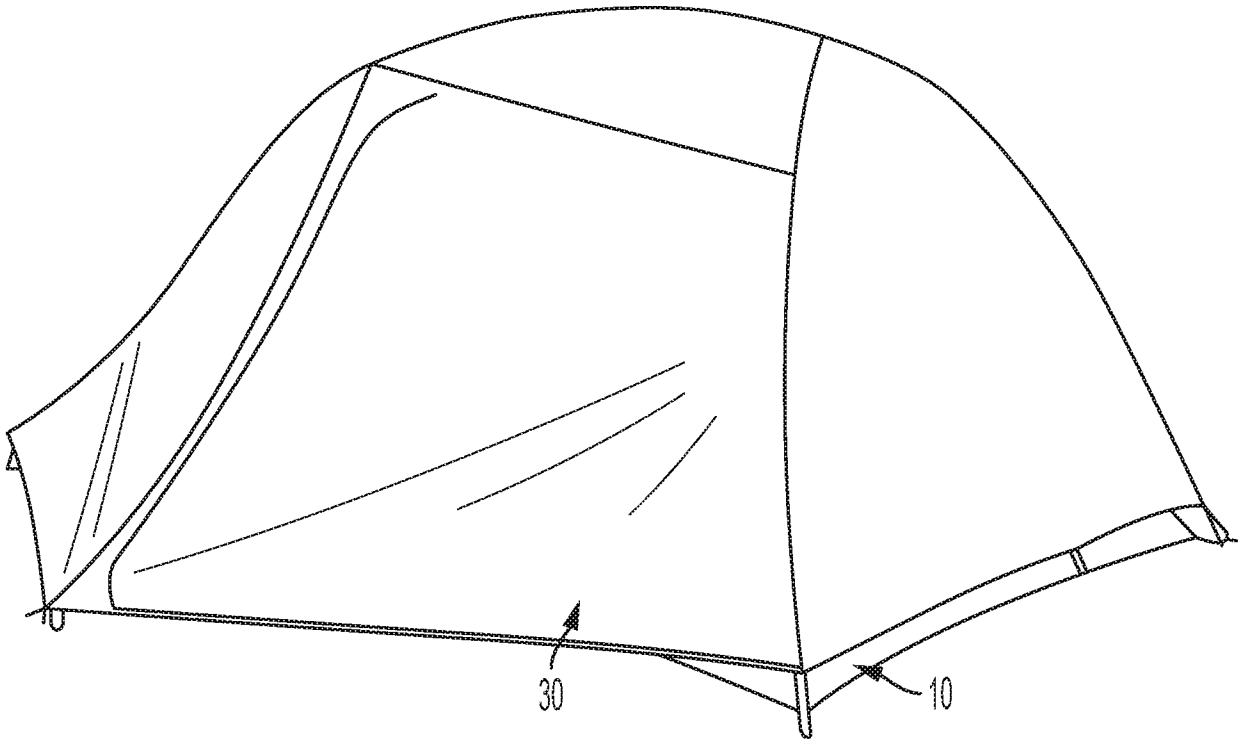
FIG. 4 is a perspective view of a tent including a tent canopy having several features that may be incorporated in an embodiment of the invention.

In a further embodiment of the invention as detailed in FIG. 4, a tent canopy 30 is shown placed as a rain fly over exemplary tent 10. Tent canopy 30 is typically a nylon, polyester, or blend of polyester/cotton textile treated with silicone or other suitably waterproof material, that in an embodiment of the present invention may include graphene-enhanced yarns that will improve the durability, strength, and waterproof integrity of tent canopy 30.

Figure 5:
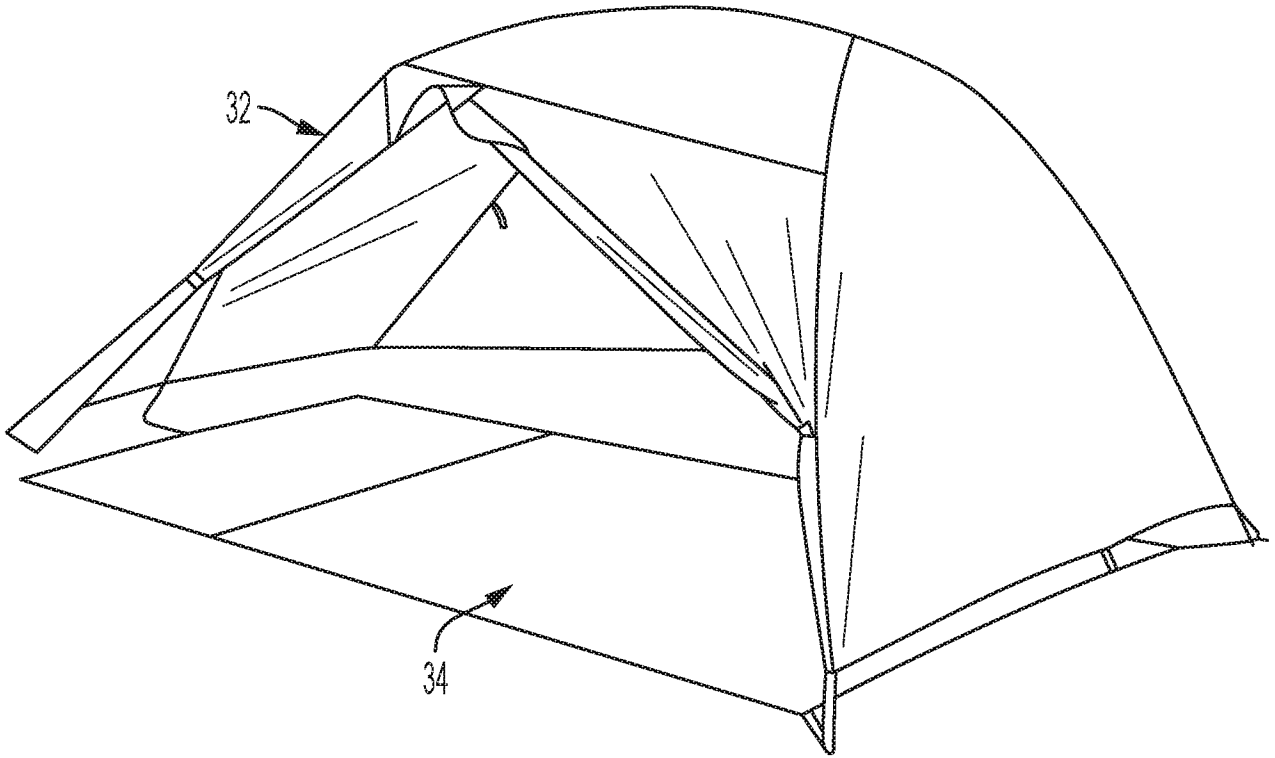
FIG. 5 is a perspective view of a tent features including a tent fly and a tent footprint having several features that may be incorporated in an embodiment of the invention.

In a related feature of tents shown in FIG. 5, further detail of an embodiment of the present invention includes an improved tent fly 32. In such an embodiment, graphene may be mixed with the waterproof coating material and applied to the tent canopy 30 or fly 32, resulting in improved elements of dramatically improved strength, durability, tear and puncture resistance and waterproof integrity. These features of the embodiment shown exemplify the versatility of the present invention, such that graphene enhancement may be applied to all tent components comprising fabric. As persons of ordinary skill in the art will appreciate, the graphene may be mixed with the coating material and with the fabric in a variety of methods that are known in the art.

A further embodiment of the invention applied to a tent canopy 30 or tent fly 32 may include further application of graphene-enhanced product where it is engineered using a material that filters out specific ultraviolet radiation that can deteriorate tent materials such as nylon or polyester. Ultraviolet radiation can also deteriorate a fabric's color or dye. Given that fabrics used in outdoor equipment are often brightly colored in order to improve their visibility, protection against the deterioration of color caused by UV radiation is an important enhancement in safety. In a preferred embodiment, the improved tent material might include titanium dioxide, a sunscreen that is known in the art for protecting fabric from deterioration from ultraviolet radiation that is part of incident solar radiation.

In another embodiment of the present invention depicted in FIG. 5, graphene-enhancement may be used to improve a tent accessory, such as a tent footprint 34. As shown in FIG. 5, tent footprint 34 is typically in the known art a nylon or polyester textile with a waterproof polyurethane or silicone coating that is used to protect the tent floor 16 from abrasion. The protection provided by a tent footprint 34 is vital due to the high cost of tents, specifically the tent body, and furthermore due to the likely inability of a tent user to replace a tent if the tent fails while the user is engaged in remote outdoor activity. In many circumstances, tent floor 16 will be subjected to the most severe stresses experienced by any element in the tent ecosystem during the use of the tent 10. In the embodiment shown in FIG. 5, the graphene-enhanced tent footprint 34 provides dramatically improved protection of the bottom of a tent 10 from abrasion, puncture and tear, and persons of ordinary skill will recognize that it is less expensive and more efficient to replace a tent footprint 34 than it is to replace an entire tent 10.

Further in the embodiment comprising tent footprint 34, the yarns and fibers used in the production of the tent footprint 34 may be graphene-enhanced in any manner discussed herein. In addition, in such embodiments of the present invention, graphene may be mixed with a suitable waterproof coating material and applied to the tent footprint 34.

In all embodiments of the present invention disclosing any and all elements of the entire tent ecosystem, fabric elements might include nylon and/or polyester substrates. In the prior art, nylon is typically preferred as it is stronger than polyester, but polyester is sometimes used. The enhancement with graphene of any fabric included in a tent will dramatically improve that fabric's performance. As a further example of an embodiment of the present invention, in a tent 10 the fly 32 might be the only element comprising polyester in a tent, as polyester has better UV resistant characteristics than nylon. In the present invention, graphene improves the performance and qualities of either fabric.

Figure 6:
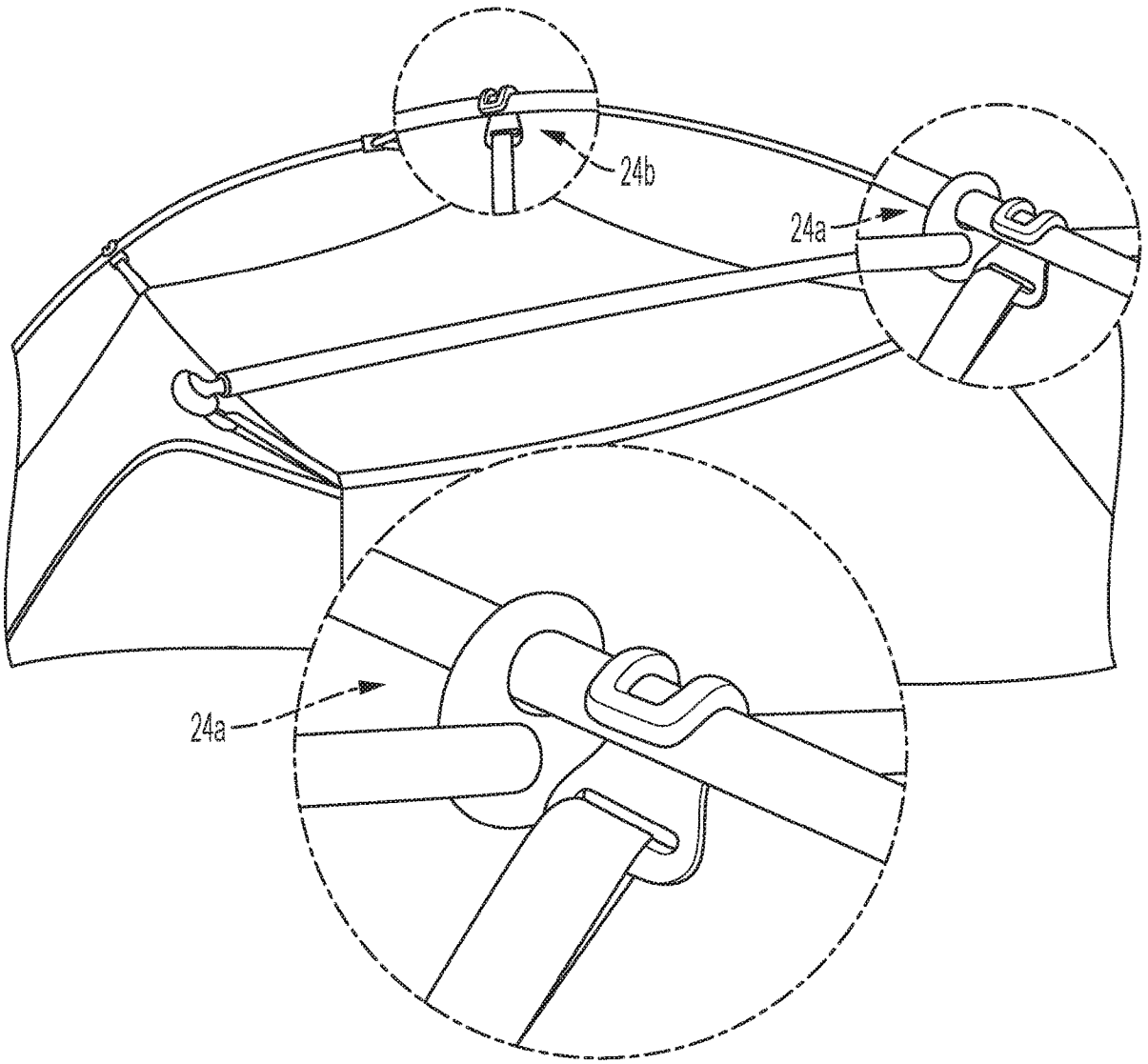
FIG. 6 is a detailed view of tent pole clips having several features that may be incorporated in an embodiment of the invention.

In another embodiment of the present invention detailed in FIG. 6, improved outdoor equipment might include graphene-enhanced tent pole clips 24. As persons of ordinary skill appreciate, tent pole clips 24 allow any variety of elements to be affixed to the tent poles 14, or affixed to other equipment. In the embodiment depicted in FIG. 6, tent pole clip 24*a* connects one tent pole 14 to a second tent pole 14 at a crossing point of such tent poles 14. Affixing two tent poles 14 in such a manner as shown improves the stability of a tent. As can be easily understood, in extreme conditions such as high wind and snow loads, such connections as tent clips 24*a* will be subjected to extreme stresses. Furthermore, failure of tent pole clips 24*a* in such extreme circumstances could be catastrophic for the occupant or occupants of the tent 10. In the depicted embodiment, an improved tent pole clip might include graphene incorporated in the material used to form the tent pole clip 24, resulting in an improved tent pole clip 24 of greatly improved strength and resistance to breakage. Typically, this might include a plastic resin compound that can be injection molded to form a plastic clip. Thus the graphene-improved clip 24 of the present invention will be stronger than tent pole clips of the prior art. Furthermore, in such an embodiment the improved tent pole clip 24 could be made thinner and smaller, resulting in less weight and reduced bulk, both highly sought-after features of outdoor equipment. In a further embodiment of the present invention, tent pole clip 24*b* may be used to affix virtually anything to tent pole 14. Further enhancing such an embodiment, tent pole clip 24*b* may be affixed to other equipment for suitable function. Typically, tent pole clip 24*b* is attached to a rope of some variety, including a woven tape material as shown, or an elastic cord or bungee, that may be connected to tent pole 14 for a variety purposes including connecting to the following:

- tent wall 12, to provide extra stability to erected tent 10;
- any fixed anchor, such as a tree, to add stability to the structure of tent 10; or
- gear that the user needs to keep near tent 10.

Figure 7:
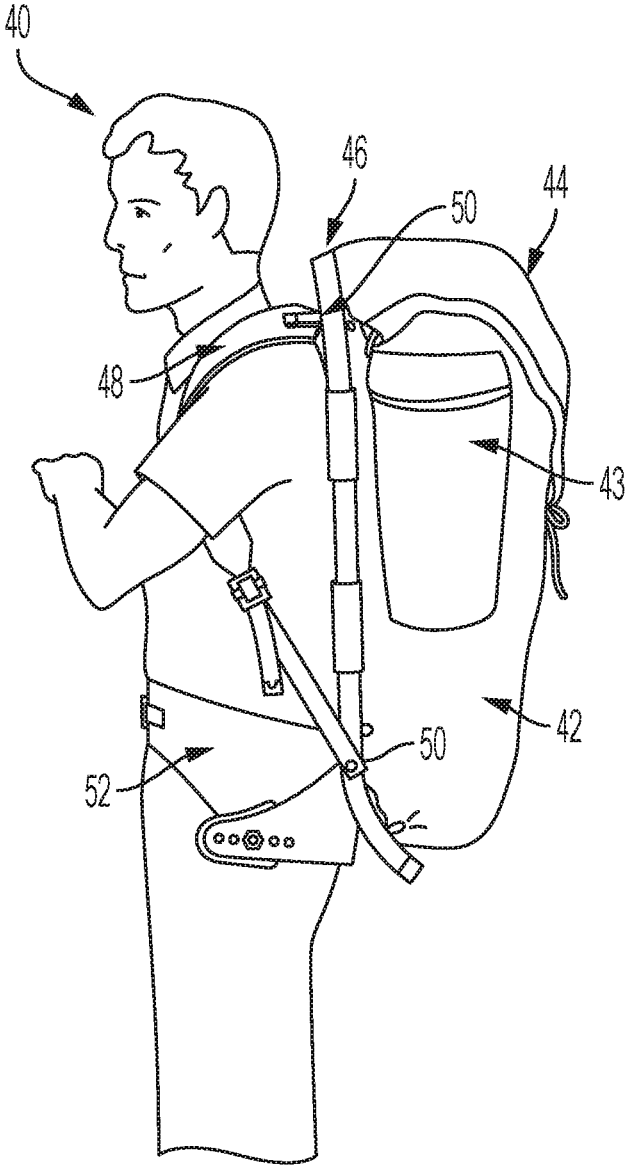
FIG. 7 is an example of a backpack having several features that may be incorporated in an embodiment of the invention.

In another embodiment of the present invention depicted in FIG. 7, a hiker 40 uses a backpack 42 to carry his gear. Exemplary backpack 42 comprises a main sack portion 42 with a flap closure 44. Closure 44 may be sealed by tying or by zippers or clasps (not shown). The main sack portion of backpack 42 may comprise any number and configuration of pockets 43 and internal compartments (not shown). Backpack 42 is attached to backpack frame 46, which in the embodiment shown is external to backpack 42, but which may also be internal to backpack 42. Frame 46 is connected to typically adjustable shoulder straps 48 at connection points 50 above and below the shoulders of hiker 40. The connection points 50 may be adjustable or fixed. Frame 46 may also be connected to a belt 52 that the hiker 10 may use to help him support the weight of backpack 42 with his hips, thereby relieving his shoulders of substantial burden.

Graphene enhanced materials of the present invention provide a dramatically improved backpack with respect to ergonomics. In the case of the rigid backpack frame 46, graphene enhanced aluminum or composite tube construction provides a stronger frame at a fraction of the weight of the prior art. This improvement applies particularly to internal frame backpacks and the materials used for the stays placed therein. Graphene enhanced fabrics used in the construction of backpack 42, including any pockets 43 and closures 44 produce a stronger, more durable backpack that is highly resistant to failure from stresses of friction against frame 46 or from stresses applied at connection points 50 to either shoulder straps 48 or belt 52. Further, graphene enhanced materials comprising connection points 50 will result in reduced weight and increased strength and durability and structural integrity of the complete backpack system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A tent, comprising:

at least one flexible tent pole configured as an arch, connected to at least one fabric wall element that is connected to a second fabric element comprising a tent floor, and a second flexible tent pole configured as an arch, where said first and second tent poles are each connected to a tent pole clip that comprises graphene, wherein at least one of said first and second tent poles and said first and second fabric elements is graphene enhanced.

2. The tent of claim 1, further comprising a sleeve connecting said at least one flexible tent pole to said at least one fabric wall element.

3. The tent of claim 2, wherein said sleeve comprises graphene enhanced fabric.

4. The tent of claim 1, further comprising at least one of a tent footprint, a tent canopy, and a tent fly, wherein one of said tent footprint, said tent canopy, and said tent fly comprises graphene.

5. The tent of claim 4, wherein one of said tent canopy and said tent fly comprises graphene and a sunscreen.

6. The tent of claim 5, wherein one of said tent canopy and said tent fly comprises fabric including graphene applied as a coating.

7. The tent of claim 5, wherein one of said tent canopy and said tent fly comprises fabric including thread extruded with graphene.

8. The tent of claim 1, further comprising a grommet; and fabric reinforcement at the site of the grommet.

9. The tent of claim 8, wherein the fabric reinforcement comprises graphene.

10. The tent of claim 1, wherein the tent pole clip is configured to permit it to connect to other equipment.

11. The tent of claim 10, where said other equipment comprises at least one of a backpack frame;

a waist belt;

a shoulder strap;

a backpack sack portion;

a knapsack; and luggage.

12. A portable shelter, comprising:

at least one flexible pole configured as an arch, connected to at least one fabric wall element that is connected to a second flexible pole configured as an arch, where said first and second poles are each connected to a pole clip that comprises graphene, wherein at least one of said first and second tent poles and said fabric wall element is graphene enhanced.

13. The portable shelter of claim 12, where said clip is configured to permit it to connect to other equipment.

* * * * *